US009782046B1

(12) United States Patent
Torres

(10) Patent No.: US 9,782,046 B1
(45) Date of Patent: Oct. 10, 2017

(54) BACK-SCRUBBING DEVICE

(71) Applicant: Tony Torres, Kew Gardens, NY (US)

(72) Inventor: Tony Torres, Kew Gardens, NY (US)

( * ) Notice: Subject to any disclaimer, the term of this patent is extended or adjusted under 35 U.S.C. 154(b) by 16 days.

(21) Appl. No.: 14/993,576

(22) Filed: Jan. 12, 2016

(51) Int. Cl.
*A47K 7/02* (2006.01)

(52) U.S. Cl.
CPC ..... *A47K 7/022* (2013.01)

(58) Field of Classification Search
CPC ..... A47K 7/022; A47K 7/02; A47K 10/00; A47K 10/02; A47K 10/12; A47K 10/14; B63B 59/08; A63B 5/20
USPC ..... 15/222; 119/707
See application file for complete search history.

(56) References Cited

U.S. PATENT DOCUMENTS

| | | | | |
|---|---|---|---|---|
| 1,714,687 A | | 5/1929 | Mckeag | |
| 1,999,846 A | | 4/1935 | Page | |
| D147,140 S | | 7/1947 | Valborg | |
| 3,875,933 A | | 4/1975 | Schwab | |
| 4,512,054 A | * | 4/1985 | Clark | A47K 7/022 15/210.1 |
| 5,504,963 A | * | 4/1996 | Bynum | A47K 7/022 15/208 |
| 5,555,591 A | | 9/1996 | Chang | |
| 6,098,236 A | | 8/2000 | Chen | |
| 7,207,294 B2 | * | 4/2007 | Stasio | A01K 15/026 119/707 |
| 8,434,191 B2 | * | 5/2013 | Shorees | A47K 7/022 15/222 |
| 8,561,250 B2 | | 10/2013 | Abraham | |
| 2008/0263801 A1 | | 10/2008 | Morris | |

FOREIGN PATENT DOCUMENTS

| | | | | |
|---|---|---|---|---|
| CA | 2145049 A1 | | 9/1996 | |
| JP | 3192093 U | * | 7/2014 | A47K 10/02 |

OTHER PUBLICATIONS

Computer generated English translation of JP 3192093 U, Jul. 2014, Okazaki.*

* cited by examiner

*Primary Examiner* — Laura C Guidotti

(57) ABSTRACT

The back scrubbing device is an absorbent textile that is adapted for use in cleaning the back of an individual person. Specifically, the back scrubbing device is formed with a plurality of knobs that provide a scrubbing surface that can be used to remove soil and other extraneous matter. The back scrubbing device comprises a first cloth, a first handle, and a second handle.

1 Claim, 4 Drawing Sheets

BACK-SCRUBBING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal care and grooming devices, more specifically, a device configured for use in cleaning the back of people.

SUMMARY OF INVENTION

The back scrubbing device is an absorbent textile that is adapted for use in cleaning the back of an individual person. Specifically, the back scrubbing device is formed with a plurality of knots that provide a scrubbing surface that can be used to remove soil and other extraneous matter.

These together with additional objects, features and advantages of the back scrubbing device will be readily apparent to those of ordinary skill in the art upon reading the following detailed description of the presently preferred, but nonetheless illustrative, embodiments when taken in conjunction with the accompanying drawings.

In this respect, before explaining the current embodiments of the back scrubbing device in detail, it is to be understood that the back scrubbing device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the back scrubbing device.

It is therefore important that the claims be regarded as including such equivalent construction insofar as they do not depart from the spirit and scope of the back scrubbing device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to potential embodiment of the disclosure, which are illustrated in FIGS. 1 through 6.

Figure 6:
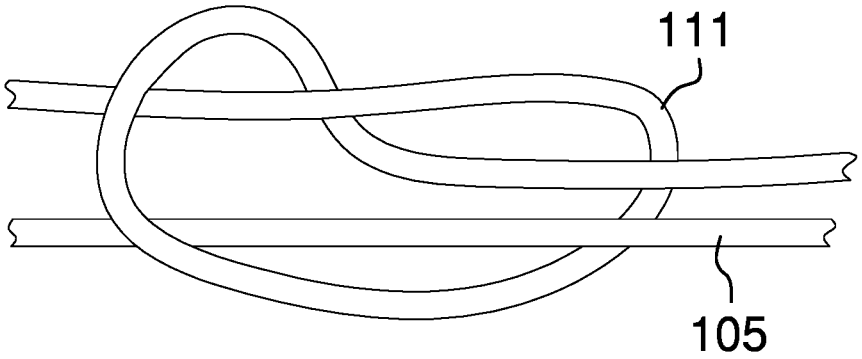
FIG. 6 is a detail view of an embodiment of the disclosure.

In the first potential embodiment of the disclosure, the back scrubbing device comprises a first cloth 101, a first handle 102, and a second handle 103. The first cloth 101 is made of a water absorbent textile. The first cloth 101 can be either a tubular shaped textile or a flat rectangular textile shaped textile. The first cloth 101 has formed in it a plurality of knots 104. As shown in FIG. 6, each knot from the plurality of knots 104 is created by manipulating the first cloth 101 to form an interlaced arrangement. In the first potential embodiment of the disclosure, each knot from the plurality of knots 104 is made using an overhand knot 111 arrangement.

The first cloth 101 is further formed with a first end 131 and a second end 132. The first end 131 is attached to the first handle 102. The second end 132 is attached to the second handle 103. The first handle 102 and second handle 103 are identical. The first handle 102 and the second handle 103 are adapted to be grasped by hands 188 of the user 141. The first handle 102 and the second handle 103 are formed in the shape of a loop that is connected to itself. The first end 131 of the first cloth 101 is attached to the first handle 102 using a knot. The second end 132 of the first cloth 101 is attached to the second handle 103 using a knot.

The first cloth 101 can be made of several textile materials including, but not limited to terrycloth. The first handle 102 and the second handle 103 can be made of several materials. Suitable materials include, but are not limited to, polyethylene, polyvinylchloride, brass or aluminum. The closed loops that make up the first handle 102 and the second handle 103 can be made of several shapes including, but not limited to, circular, oval, triangular, or rectangular. Alternatively, the first handle 102 can be formed by tying the first end 131 to the middle of the first cloth 101 thus forming a loop. Similarly, the second handle 103 can be formed by tying the second end 132 to the middle of the first cloth 101 thus forming a loop.

Figure 1:
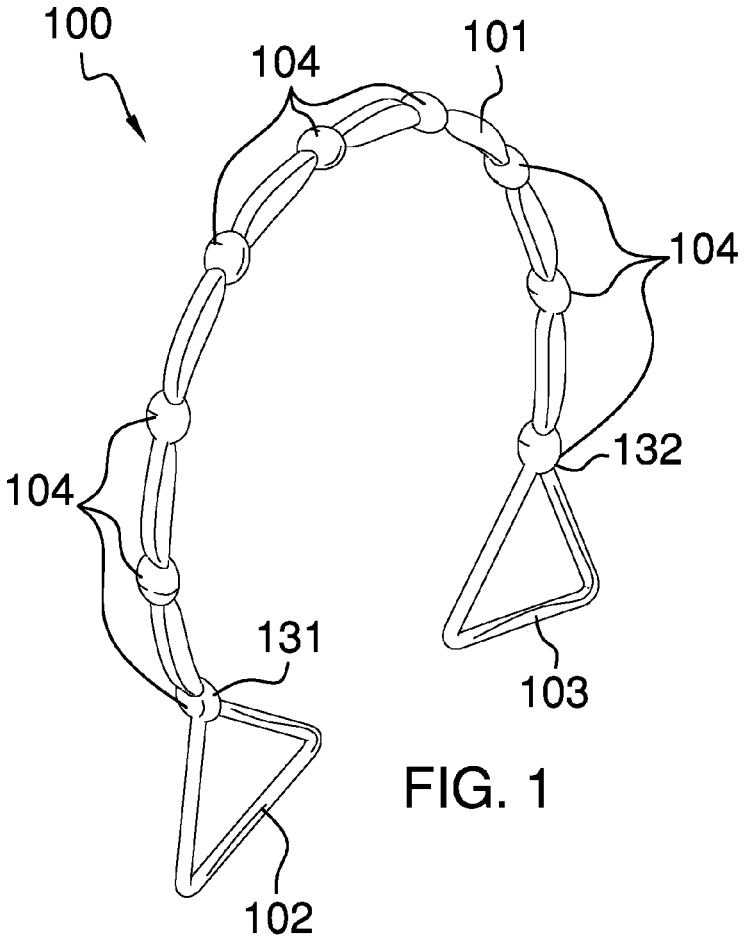
FIG. 1 is a perspective view of an embodiment of the disclosure.
Figure 2:
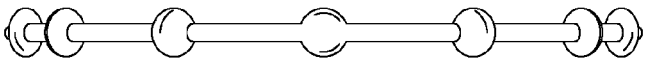
FIG. 2 is a top view of an embodiment of the disclosure.
Figure 3:
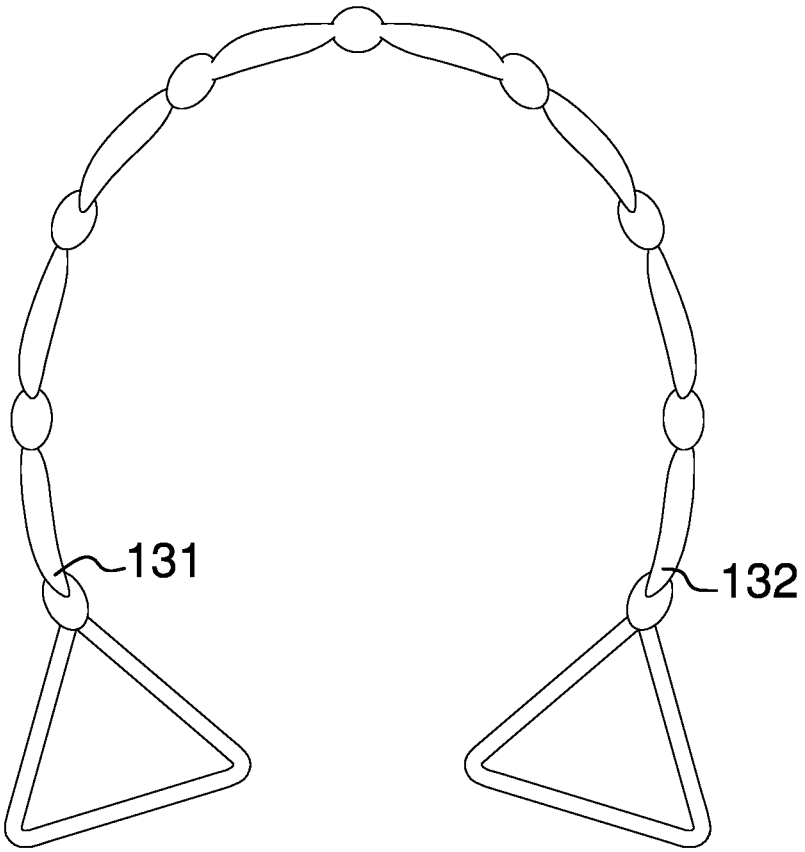
FIG. 3 is a front view of an embodiment of the disclosure.
Figure 4:
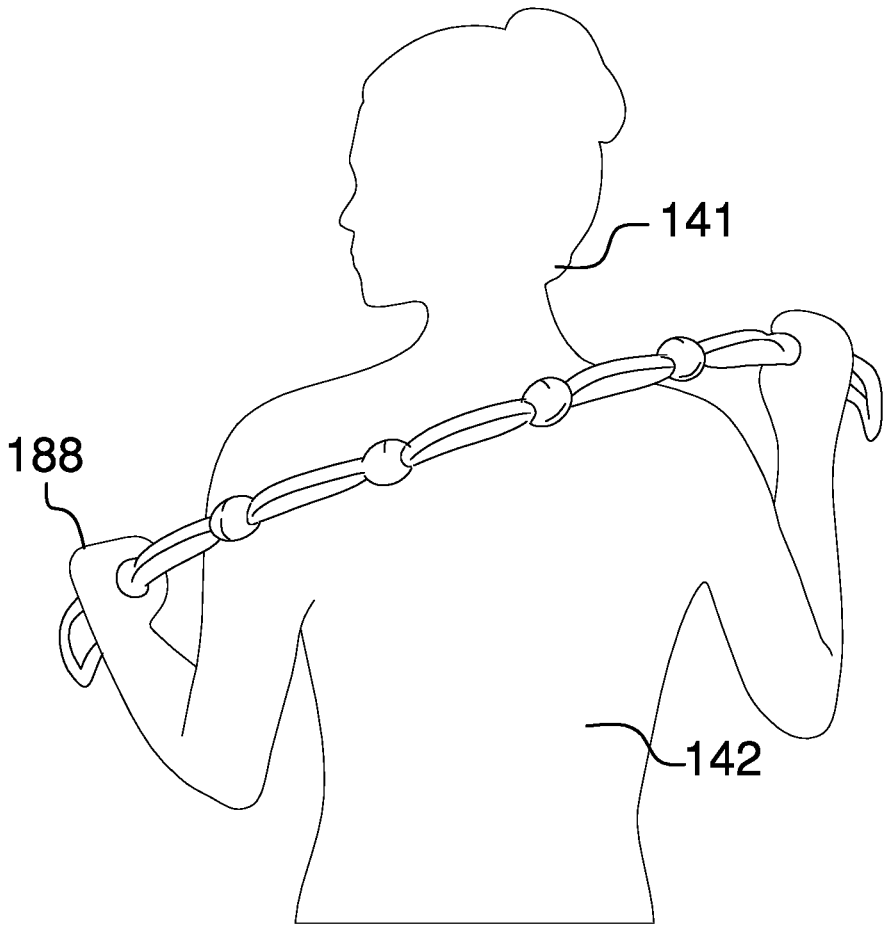
FIG. 4 is a view of an embodiment of the disclosure in use.
Figure 5:
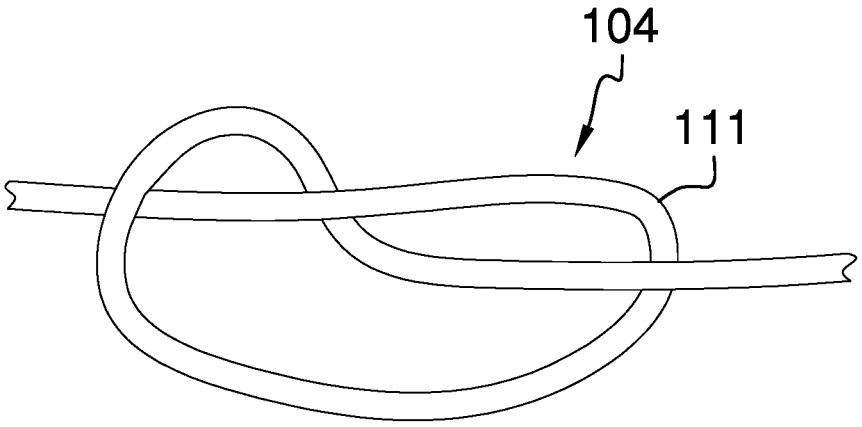
FIG. 5 is a detail view of an embodiment of the disclosure.

In a second potential embodiment of the disclosure, as shown in FIG. 1, the plurality of knots 104 comprises seven knots. The first handle 102 and the second handle 103 are both formed in a triangular loop and are made from plastic.

To use the first and second potential embodiment of the disclosure, the invention 100 is pulled tight using the first handle 102 and the second handle 103. The user 141 then presses the invention 100 against their back 142 and using the first handle 102 and the second handle 103 the user 141 draws the invention 100 back and forth against their back 142.

The following definition was used in this disclosure:

Textile: As used in this disclosure, a textile is a flexible material that is woven, knitted or felted. A synonym in common usage for this definition of textile include fabric.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A scrubbing device comprising a cloth, a first handle, and a second handle;

wherein the scrubbing device is adapted for use with people;

wherein the scrubbing device is adapted for use in cleaning the backs of people;

wherein the cloth is made of a water absorbent textile;

wherein the cloth has formed in it a plurality of knots;

wherein each knot from the plurality of knots is made using an overhand knot arrangement;

wherein the cloth is further formed with a first end and a second end;

wherein the first handle and the second handle are adapted to be grasped by hands of the user;

wherein the first handle is formed in the shape of a loop;

wherein the second handle is formed in the shape of a loop;

wherein the first end of the cloth is attached to the first handle using a knot;

wherein the second end of the cloth is attached to the second handle using a knot;

wherein the plurality of knots comprises between five and nine knots inclusive;

wherein the first handle is formed in a triangular loop;

wherein the second handle is formed in a triangular loop.

* * * * *